US008684210B2

(12) United States Patent
Richter

(10) Patent No.: US 8,684,210 B2
(45) Date of Patent: Apr. 1, 2014

(54) WATER COOLER DISPLAY APPARATUS FOR POSITIONING, STORING AND DISPLAYING ITEMS THEREON

(75) Inventor: Charles W. Richter, Ocean City, MD (US)

(73) Assignee: CEMCO, Inc., Rehoboth, DE (US)

( * ) Notice: Subject to any disclaimer, the term of this patent is extended or adjusted under 35 U.S.C. 154(b) by 967 days.

(21) Appl. No.: 12/076,999

(22) Filed: Mar. 26, 2008

(65) Prior Publication Data

US 2009/0242555 A1 Oct. 1, 2009

(51) Int. Cl.
*A47G 19/00* (2006.01)
*A47F 3/00* (2006.01)
*A47F 5/14* (2006.01)

(52) U.S. Cl.
USPC ..... 220/23.83; 312/140; 211/182

(58) Field of Classification Search
USPC ..... 220/23.83, 23.89, 23.87, 697, 694, 699, 220/694.1, 729, 730, 735, 737, 573.4, 220/23.91, 761, 23.86; 215/386; 248/359; 340/140; 222/325, 145.1, 145.5, 145.6; 211/163, 110, 182, 189, 194; 62/337–339, 389, 400; 312/249, 140, 312/114, 263, 257.1, 107, 108, 111, 125, 312/135, 305, 280, 265.5
See application file for complete search history.

(56) References Cited

U.S. PATENT DOCUMENTS

| | | | | | |
|---|---|---|---|---|---|
| 1,393,050 | A | * | 10/1921 | Talley et al. | 312/135 |
| 3,417,873 | A | * | 12/1968 | Leptrone | 211/77 |
| 3,654,716 | A | * | 4/1972 | Moss | 40/473 |
| 4,609,975 | A | * | 9/1986 | Badolato et al. | 362/125 |
| 4,895,418 | A | * | 1/1990 | Medellin et al. | 312/249.7 |
| 5,123,720 | A | * | 6/1992 | Blomster et al. | 312/263 |
| 5,292,028 | A | * | 3/1994 | Patterson et al. | 220/574 |
| 5,651,595 | A | * | 7/1997 | Willis | 312/249.2 |
| 5,909,932 | A | * | 6/1999 | Shih | 312/135 |
| 6,065,303 | A | * | 5/2000 | Harris | 62/457.5 |
| 6,666,347 | B1 | * | 12/2003 | Diamond | 220/4.03 |
| 6,824,013 | B2 | * | 11/2004 | Harrison et al. | 222/66 |
| 6,905,020 | B2 | * | 6/2005 | Chang | 206/373 |
| 6,928,950 | B2 | * | 8/2005 | Trammell et al. | 114/382 |
| 2006/0191284 | A1 | * | 8/2006 | Fuller | 62/389 |

* cited by examiner

*Primary Examiner* — Bryon P. Gehman
*Assistant Examiner* — Shawn M Braden
(74) *Attorney, Agent, or Firm* — Breiner & Breiner, L.L.C.

(57) ABSTRACT

A water cooler display apparatus for positioning, storing and/or displaying items thereon is disclosed. The apparatus is positioned on and around a water cooler bottle on a water dispensing device thereby enabling use of typically unusable space around the water dispensing device. The apparatus includes a first housing member, a positioning member adjacent to and/or on an interior surface of the first housing member for positioning the apparatus on and around the water cooler bottle, and one or more securing members which hold or secure any suitable number of items on the apparatus. The apparatus may also include a second housing member on the first housing member.

24 Claims, 11 Drawing Sheets

20
60
48
26
26
24
40
40
46
28
40
34
44
60
60
60
50
30
32
32
40
42

WATER COOLER DISPLAY APPARATUS FOR POSITIONING, STORING AND DISPLAYING ITEMS THEREON

FIELD OF INVENTION

The present invention relates to a water cooler display apparatus for placement on and around a water cooler for positioning, storing and/or displaying items thereon. More particularly, the invention relates to a water cooler display apparatus for a water cooler that utilizes typically unusable space around such a water dispensing device.

BACKGROUND OF INVENTION

Many homes and business have water coolers or water dispensing devices that provide cool, purified water to the users. However, these devices are typically large and take up a lot of space. Additionally, in an office setting, many people gather around the water cooler in the mornings before work or during breaks to socialize or discuss business, world and/or social matters.

The present invention utilizes this empty and typically unusable space around a water cooler by providing an apparatus for positioning, storing and/or displaying items thereon. These and other shortcomings related to having empty and/or unusable space around a water cooler are addressed by the present invention.

SUMMARY OF INVENTION

The present invention relates to a water cooler display apparatus for placement on and around a water cooler for positioning, storing and/or displaying items thereon. More particularly, the invention relates to a water cooler display apparatus for a water cooler that utilizes typically unusable space around such a water dispensing device.

The water cooler display apparatus comprises a housing including at least a first housing member, a positioning member adjacent to and/or on an interior surface of the first housing member and at least one means for securing predetermined items to one or more exterior surfaces of the first housing member. Preferably, the means for securing is one or more openings and one or more securing members operatively positioned in said one or more openings. However, any suitable means for securing predetermined items may be used.

The first housing member has side walls which are constructed and arranged to be a size and shape suitable to fit in spaced relation around a water bottle of a water cooler. The first housing member also has a top wall which is preferably perpendicular or substantially perpendicular to the side walls of the first housing member. The first housing member also has a bottom with an opening therein.

The positioning member is preferably positioned near the upper part of the first housing member. More particularly, one surface of the positioning member is operatively positioned adjacent to and/or on an interior surface of the first housing member, wherein the interior surface is preferably the top wall of the first housing member. In use, the surface of the positioning member opposite the surface attached to the top wall preferably rests on top of a water bottle of the water cooler so that the side walls of the first housing member of the water cooler display apparatus fit around the water cooler bottle preferably without contacting or touching the sides of the water cooler bottle. The positioning member is preferably rotatable such that the first housing member of the water cooler display apparatus is rotatable around the water cooler bottle of the water dispensing device so that the side walls of the first housing member of the water cooler display apparatus may be viewed from any position around the water dispensing device.

The securing member(s) is/are operatively attachable and positioned on the first housing member, preferably, at or near the upper part of the first housing member of the water cooler display apparatus. More particularly, the securing member(s) may be constructed and arranged to be operatively positioned over, around or near the upper part or upper edge of the side walls of the first housing member of the water cooler apparatus.

The securing member(s) may be one or more of any suitable securing members such as hooks, clips, fasteners, magnets, velcro/adhesive pads, suction elements, and/or the like. The securing member(s) may be attached to the first housing by suspension through an opening at the top of the side wall or in the side wall or be adhesively or magnetically adhered to any position on the side wall.

The water cooler display apparatus may also optionally include a second housing member positioned on top of or above the first housing member. The second housing member has a bottom wall, positioned parallel to or substantially parallel to the top wall of the first housing member, and, preferably an open top. The second housing member has side walls which may be of the same or different size, width and/or shape as the side walls of the first housing member. Preferably, the side walls of the second housing member are of a similar configuration as the side walls of the first housing member. The bottom wall of the second housing member is preferably perpendicular to or substantially perpendicular to the side walls of the second housing member.

The second housing member of the water cooler display apparatus is operatively positioned on top of the first housing member. The second housing member may be rotatable in conjunction with the first housing member, rotatable independent from the first housing member and/or stationary.

One or more securing members, of the type described above in relation to the first housing member, may also be operatively attachable and positioned on one or more side walls of the second housing member, preferably, on, at, near, over or around the upper part or the upper edge of the side walls of the second housing member in a similar manner as for the first housing member.

The present invention, among other things, is to provide an apparatus for placement on and around a water dispensing device for positioning, storing and/or displaying items thereon to utilize typically unusable space around the water dispensing device.

BRIEF DESCRIPTION OF THE DRAWINGS

Referring to the drawings.

DETAILED DESCRIPTION OF PREFERRED EMBODIMENTS

Figure 1:
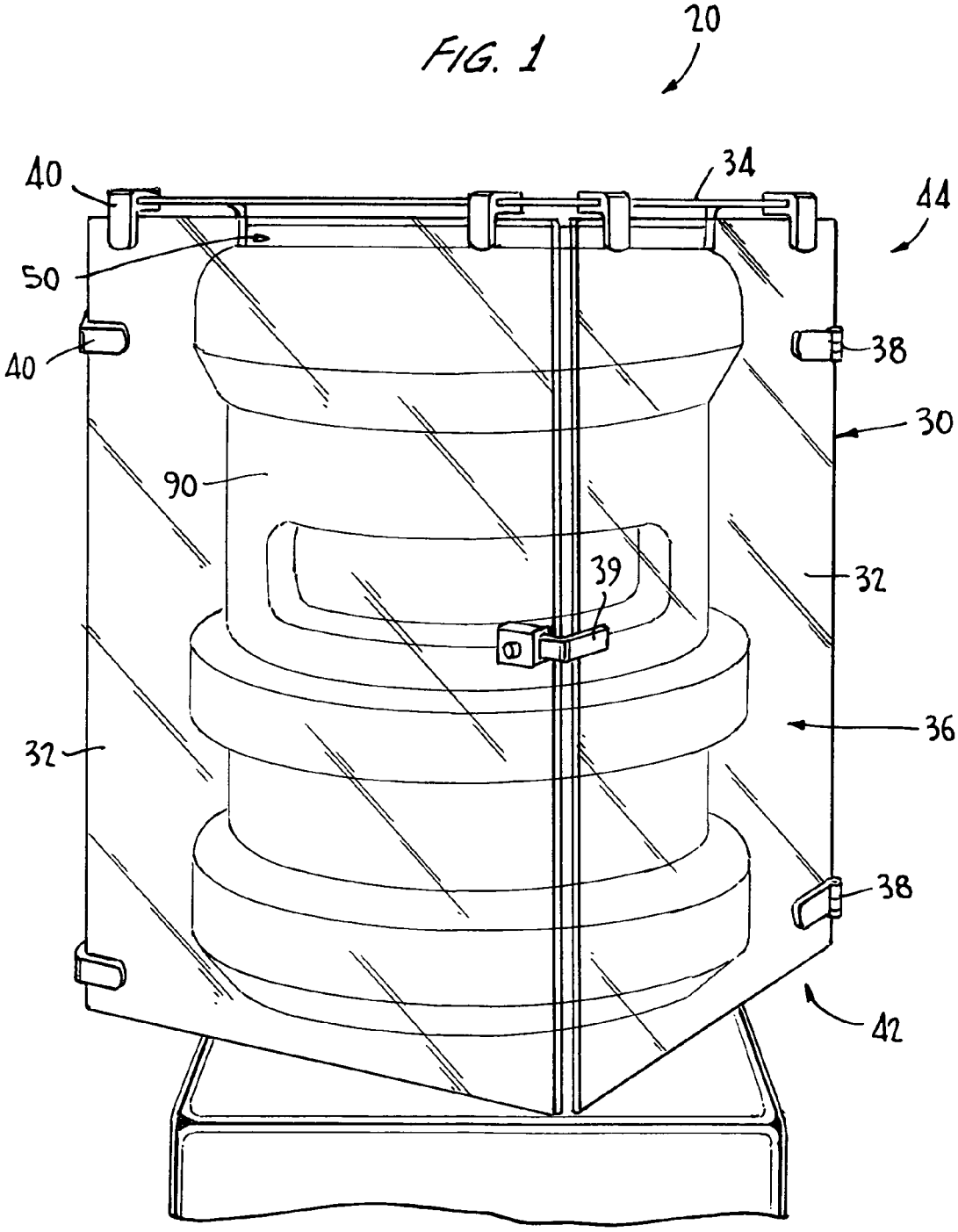
FIG. 1 is a perspective view of a first embodiment of a water cooler display apparatus of the present invention.

Referring to FIGS. 1-13, the water cooler display apparatus 20 comprises a first housing member 30, a positioning member 50 adjacent to and/or on an interior surface of the first housing member 30 at least one means for securing predetermined items to one or more exterior surfaces of the first housing, such as, e.g., openings and/or securing members 60. For simplicity of illustration, the securing members are shown as suspension members overhanging a top edge of a side wall of the housing member(s). As described herein, however, the securing members may be of different structures and attached or adhered to the display apparatus by various means. The water cooler display apparatus 20 may also include a second housing member 24 positioned on top of the first housing member 30 as detailed hereafter.

The first housing member 30 includes side walls 32 which are constructed and arranged to create an open interior space and be a size and shape suitable to fit in a spaced relation around a water cooler bottle 90 of a water cooler, i.e., water dispensing device. The side walls 32 of the first housing member 30 may be any suitable shape including, but not limited to, rectangular, square, circular, oval, diamond, and/or any other suitable shape to provide various configurations. In a preferred embodiment, each of the side walls 32 of the first housing member 30 are connected together by any suitable connecting members 40. This structure provides for accessible top and side edges for use with securing members 60, as described in more detail below. However, in another preferred embodiment, two or more of the side walls 32 of the first housing member 30 may be continual or unitary and not separate walls secured by separate connecting members. The first housing member 30 may have any suitable number of side walls 32.

The first housing member 30 also includes a top wall 34 which is preferably perpendicular or substantially perpendicular to the side walls 32 of the first housing member 30. The top wall 34 is preferably connected to the upper part 44 of the side walls 32 of the first housing member 30. More particularly, the top wall 34 may be continual with the side walls 32 of the first housing member 30 or the top wall 34 may be separate from the side walls 32 of the first housing member 30 and be connected thereto by any suitable number of connecting members 40. In a preferred embodiment, the top wall 34 is spaced from and connected to the side walls 32 of the first housing member 30 by connecting members 40 to provide an opening, and thus an edge, from which to hang securing members 60. In an embodiment where the top wall and side wall are integral or unitary in structure, an opening, e.g., a slot, can be formed in the side wall to provide an edge from which to hang a securing member 60. Further, a securing member attached to the side wall by an adhesive (permanent or releasable), magnet or suction element may be used.

In a preferred embodiment, the first housing member 30 is constructed and arranged to fit in a spaced relation on and around a water cooler bottle 90 of a water dispensing device. The first housing member 30 has a lower end 42 which is open to such an extent that the first housing member 30 can be placed over a water cooler bottle 90 of a water dispensing device via the opening in the lower end 42.

Figure 2:
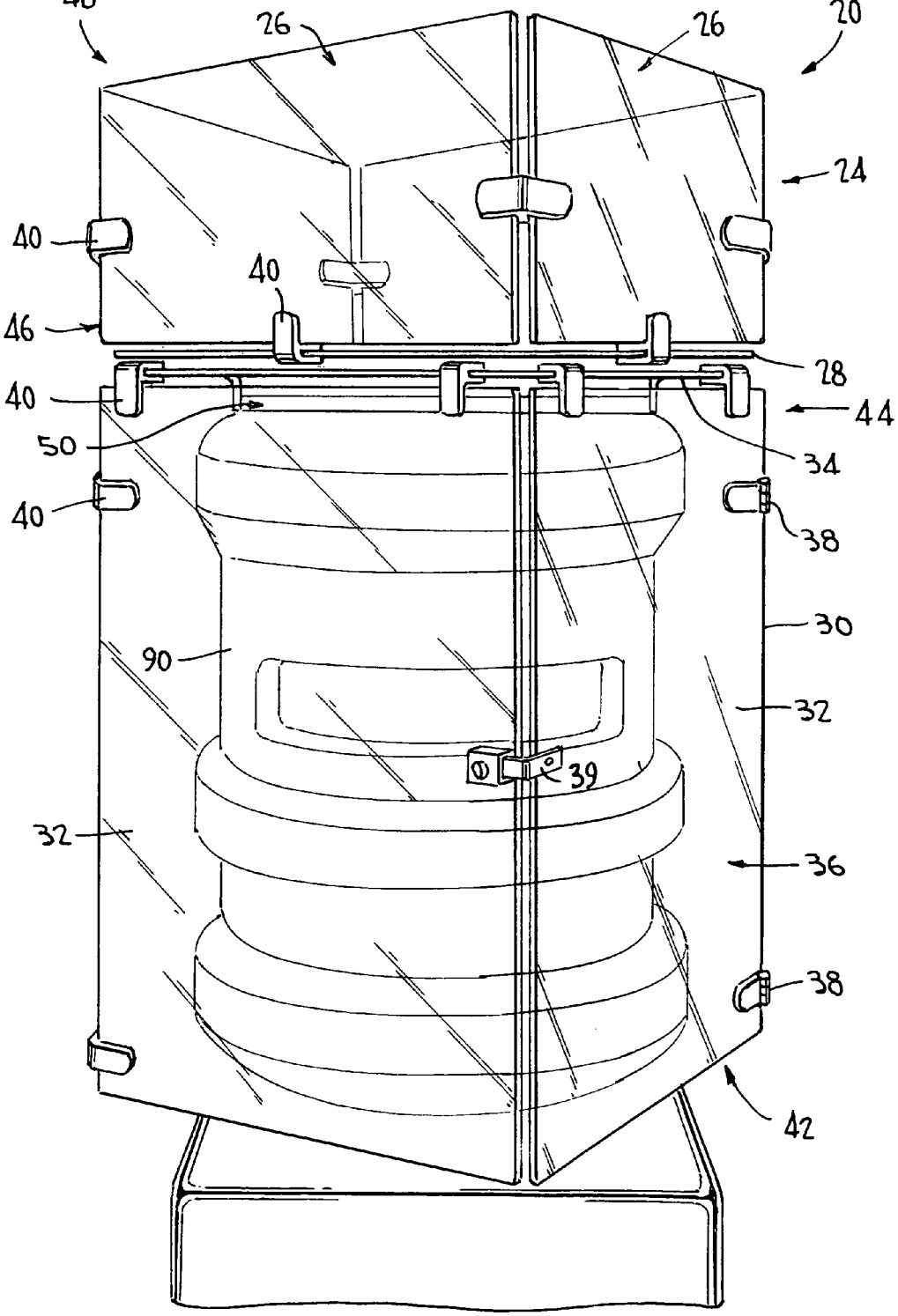
FIG. 2 is a perspective view of a second embodiment of a water cooler display apparatus of the present invention.
Figure 3:
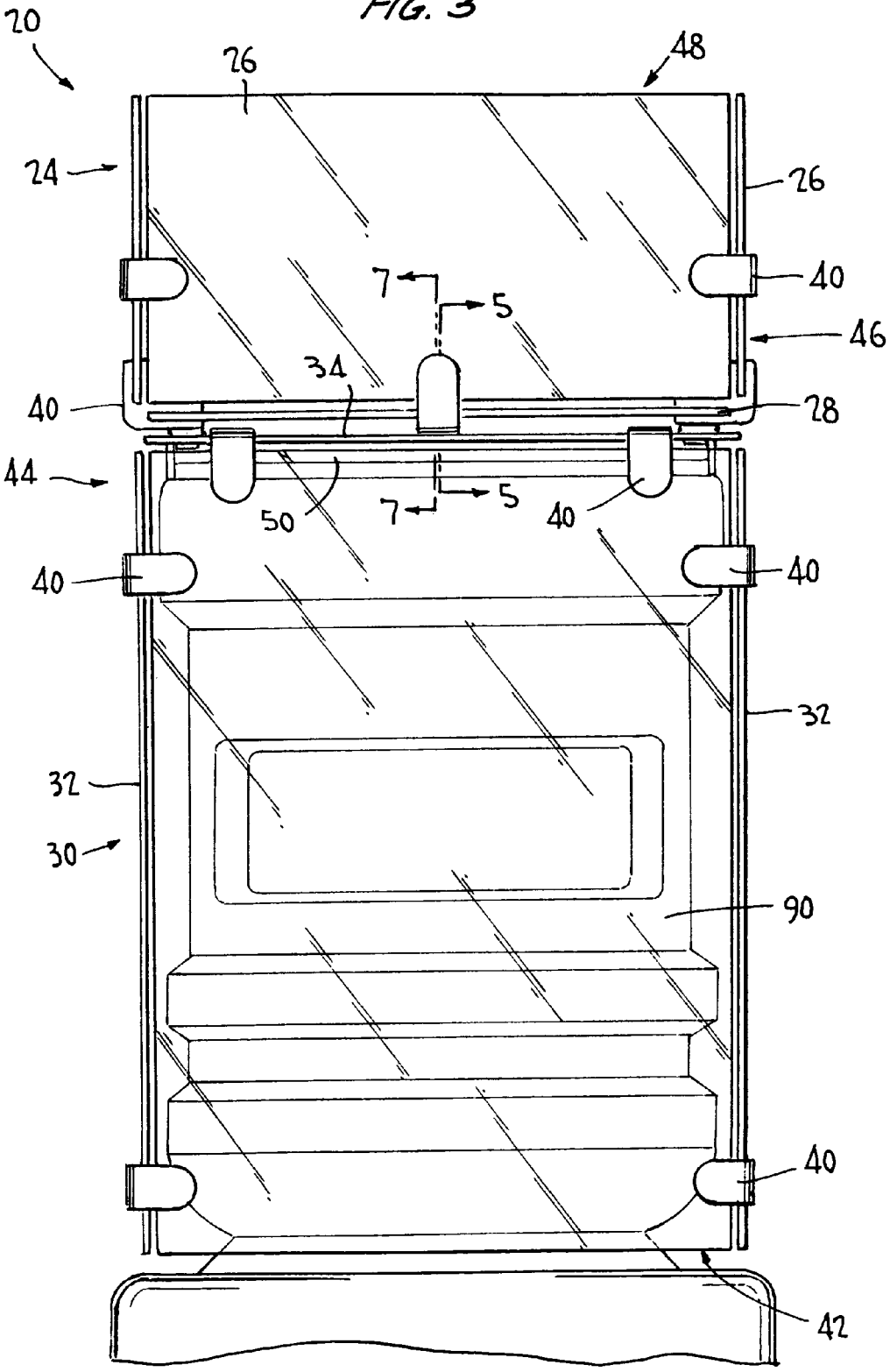
FIG. 3 is a front view of the water cooler display apparatus of FIG. 2.

In another preferred embodiment, the first housing member 30 may have a door 36, such as shown for example in FIG. 1 and FIG. 2. For example, one of the side walls 32 of the first housing member 30 may be a door 36. The door 36 may be secured to an adjacent side wall 32 of the first housing member 30 by at least one hinge 38. The door 36 may be held closed or in contact with an adjacent side wall by any suitable closing member 39, such as, but not limited to, magnets, hooks, clips, clasps and/or the like. By opening the door 36, the water cooler display apparatus 20 may be placed on or be taken off of the water cooler bottle 90 on the water dispensing device by a horizontal movement instead of having to vertically lift the water cooler display apparatus 20 on or off of the water cooler bottle on the water dispensing device.

The positioning member 50 is operatively positioned between at least a portion of the top wall 34 of the first housing member 30 of the water cooler display apparatus 20 and at least a portion of the water cooler bottle 90 of the water dispensing device. The positioning member 50 is preferably positioned near the upper part 44 of the first housing member 30 and may be attached thereto. In one preferred embodiment, the positioning member 50 is operatively positioned below and adjacent to the interior surface of the top wall 34 of the first housing member 30.

The positioning member 50 preferably rests or sits on top of the water cooler bottle 90 so that the side walls 32 of the first housing member 30 of the water cooler display apparatus 20 fit in a spaced relation around the water cooler bottle 90, i.e., without contacting or touching the sides of the water cooler bottle 90 of the water dispensing device.

The positioning member 50 is preferably rotatable such that the first housing member 30 of the water cooler display apparatus 20 is rotatable around the water cooler bottle 90 such that the side walls 32 of the first housing member 30 of the water cooler display apparatus 20 may be viewed from any position around the water dispensing device. The positioning member 50 may be any suitable positioning member including, but not limited to, a disk, a turntable, a Lazy Susan or the like.

Figure 4:
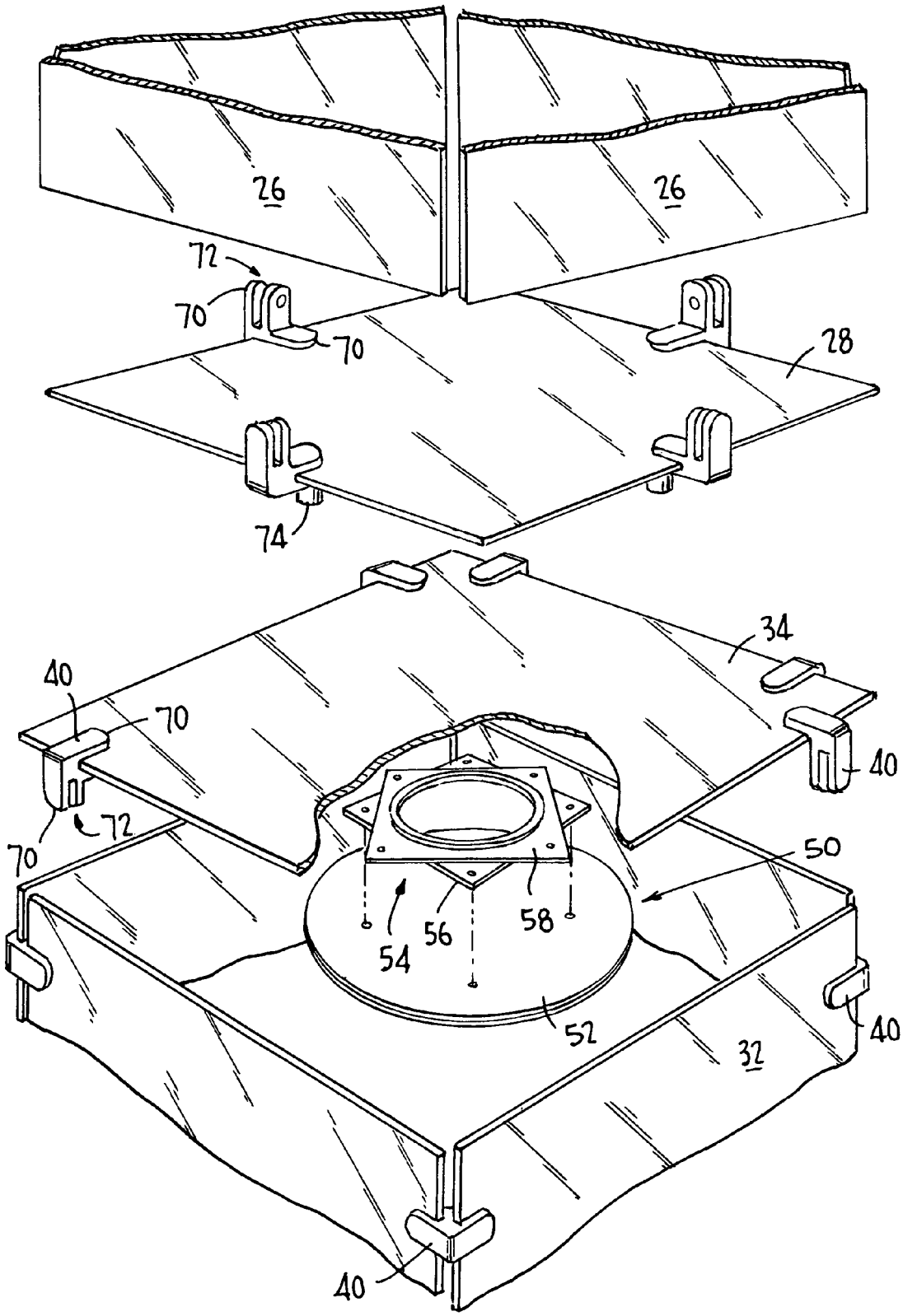
FIG. 4 is an exploded view of a first embodiment of a positioning member of the water cooler display apparatus of the present invention.
Figure 8:
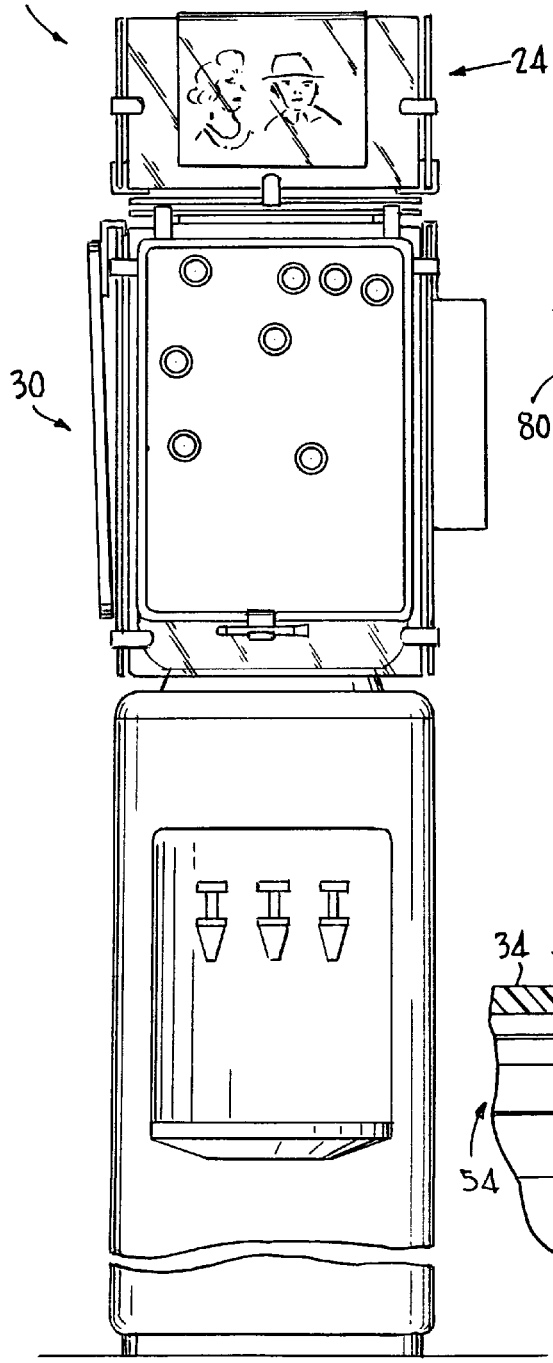
FIG. 8 is a front view of the second embodiment of the water cooler display apparatus of FIG. 2 in use.
Figure 7:
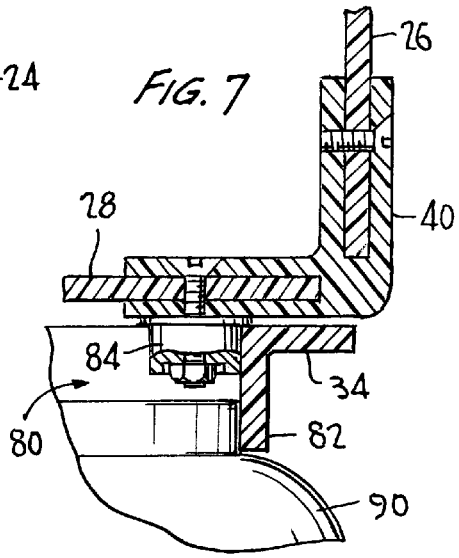
FIG. 7 is a partial cross sectional view along the line 7-7 of FIG. 3 having a positioning member as in FIG. 6.
Figure 5:
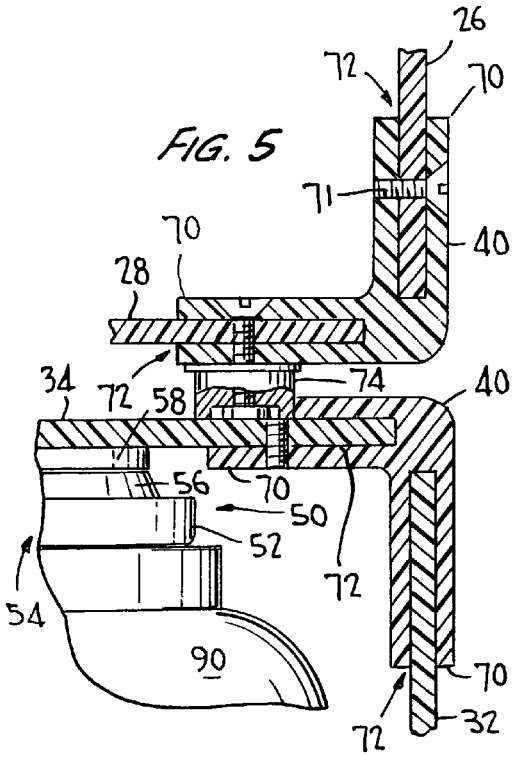
FIG. 5 is a partial cross sectional view along the line 5-5 of FIG. 3 having a positioning member as in FIG. 4.
Figure 6:
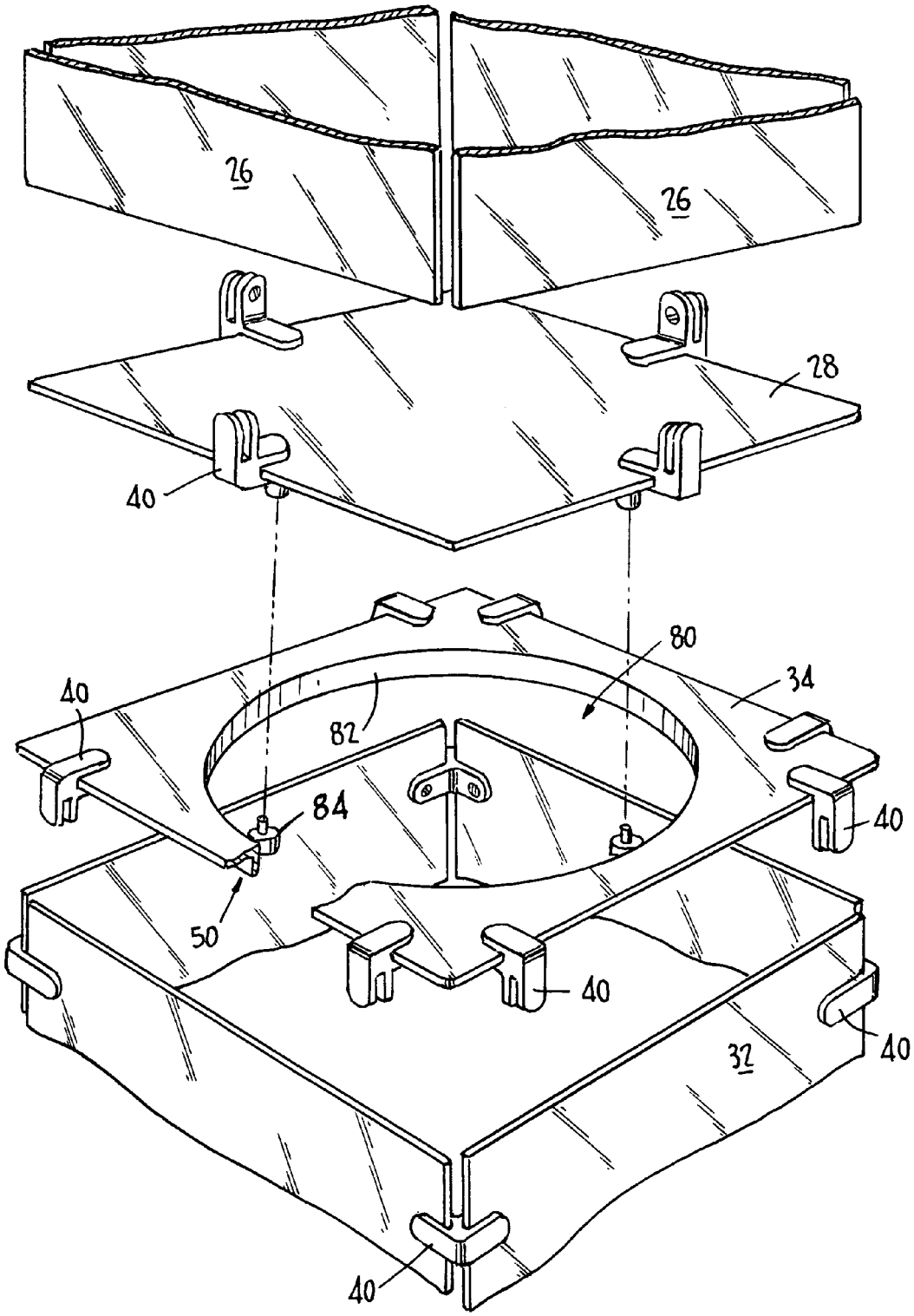
FIG. 6 is an exploded view of a second embodiment of a positioning member of the water cooler display apparatus of the present invention.
Figure 9:
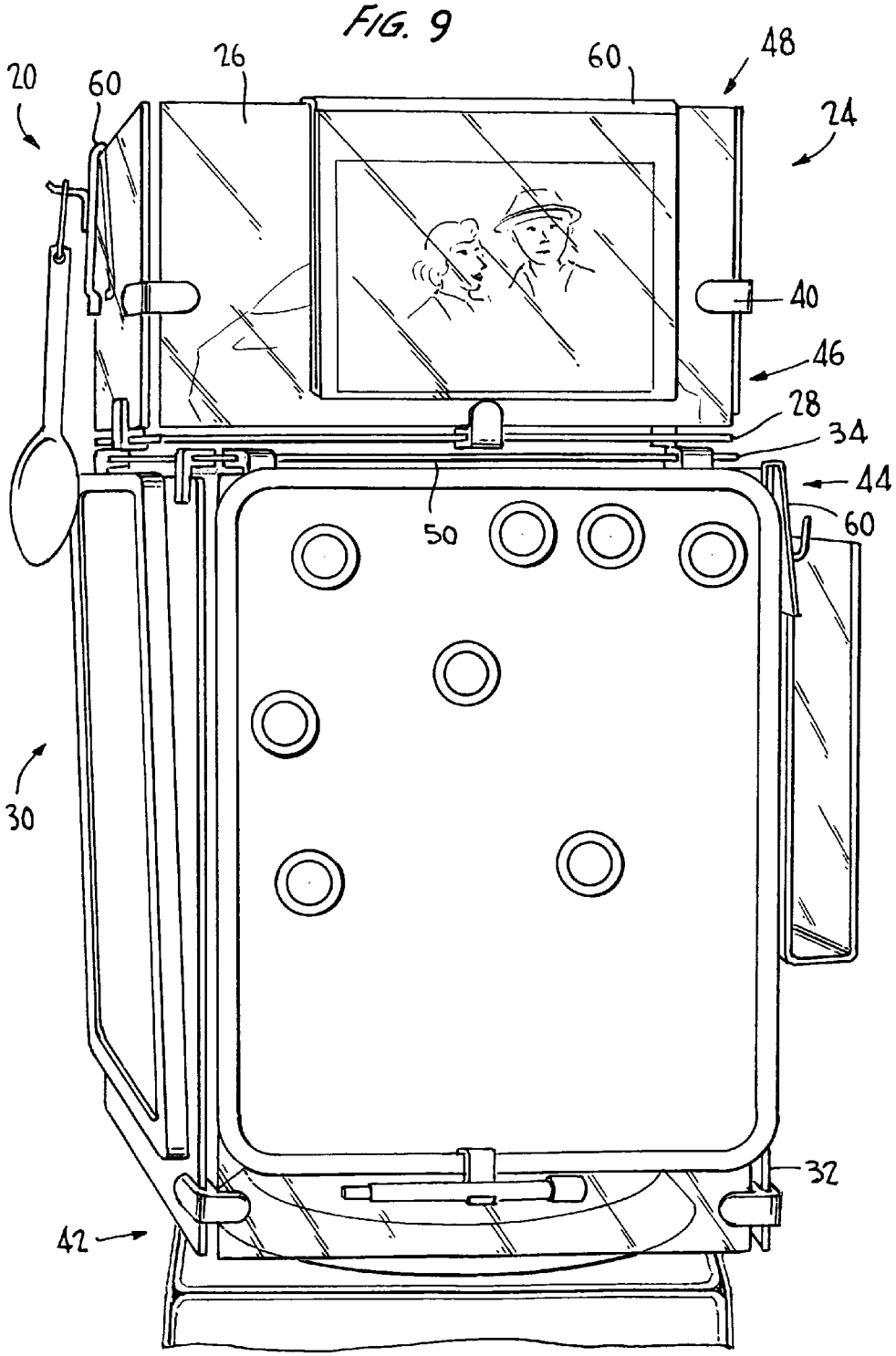
FIG. 9 is a front perspective view of the second embodiment of the water cooler display apparatus of FIG. 2 in use with a first series of items stored and displayed thereon.
Figure 10:
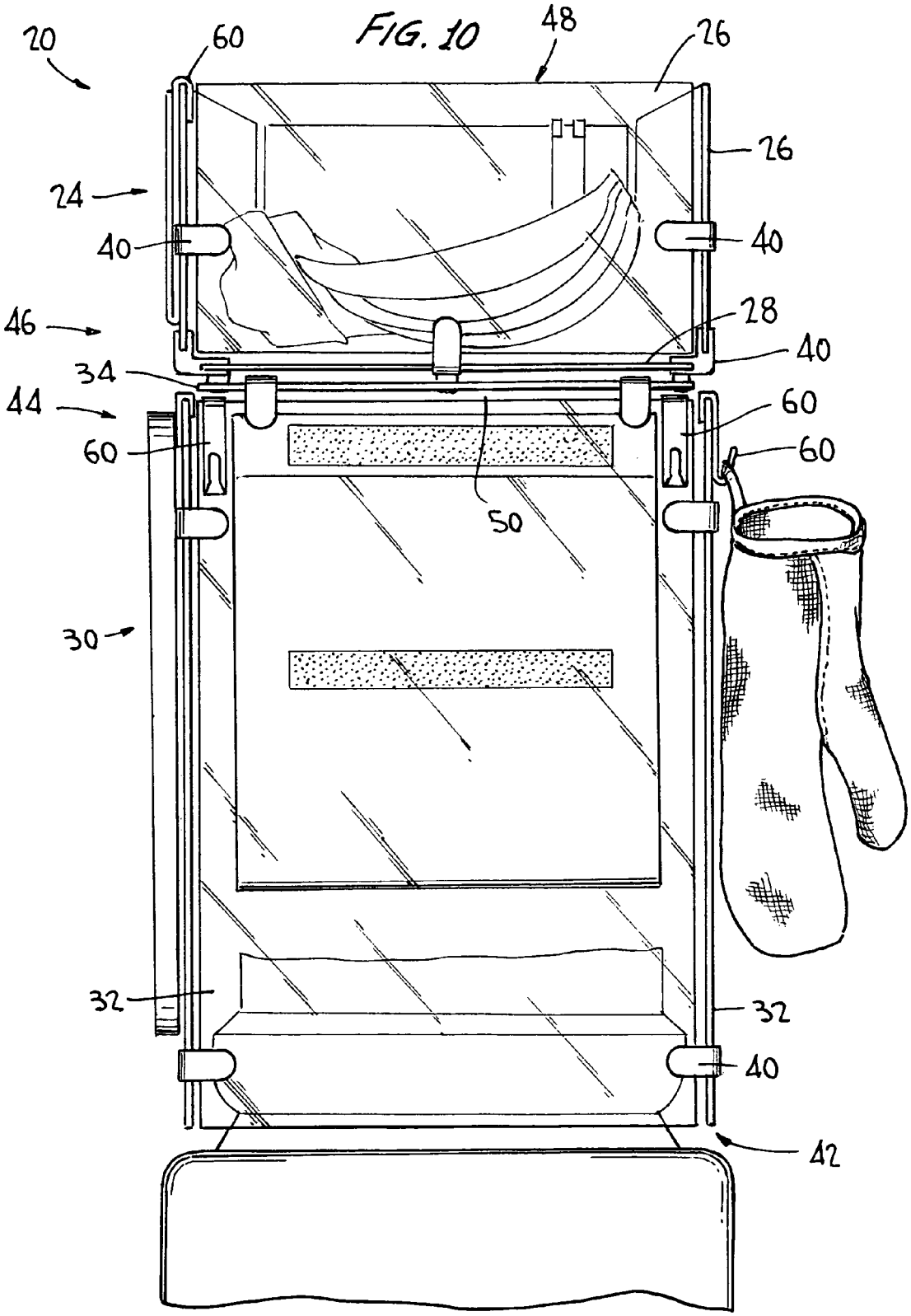
FIG. 10 is a side view of the second embodiment of the water cooler display apparatus of FIG. 2 in use showing another series of items stored and displayed thereon.
Figure 11:
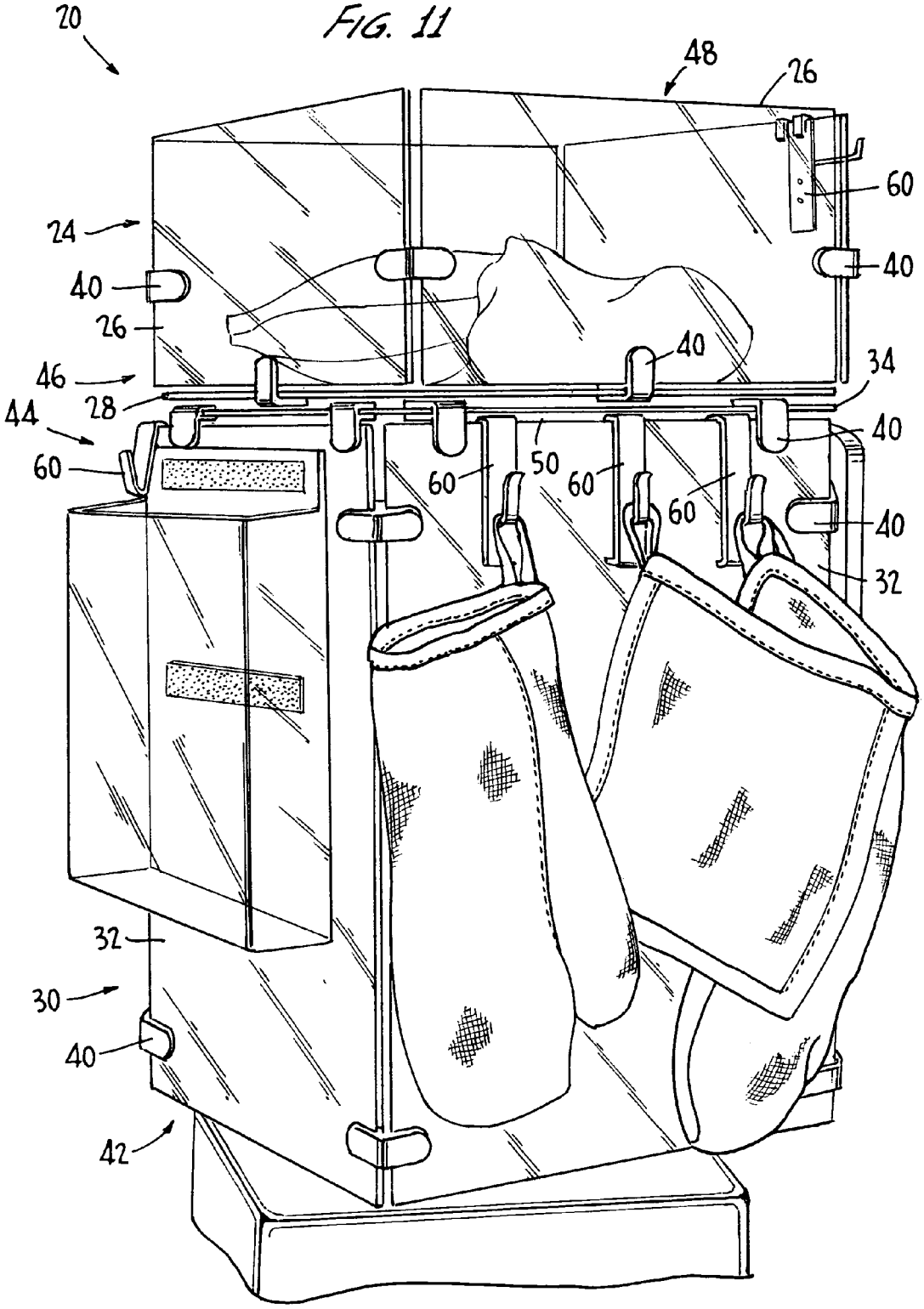
FIG. 11 is a perspective view of the water cooler display apparatus of FIG. 2 in use further showing the series of items illustrated in FIG. 10.
Figure 12:
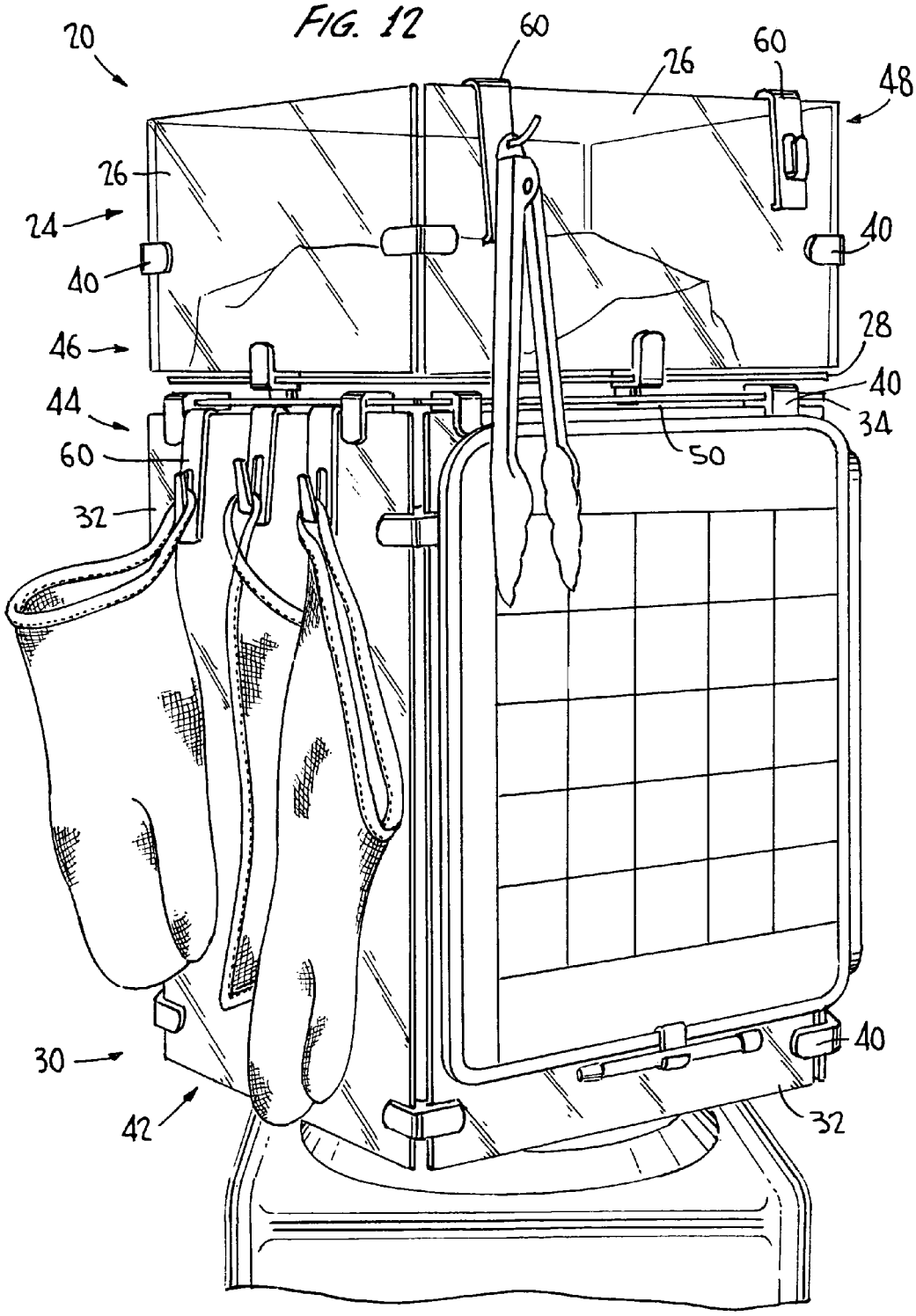
FIG. 12 is a perspective view of the water cooler display apparatus of FIG. 2 in use showing back and side walls with a series of items stored and displayed thereon.
Figure 13:
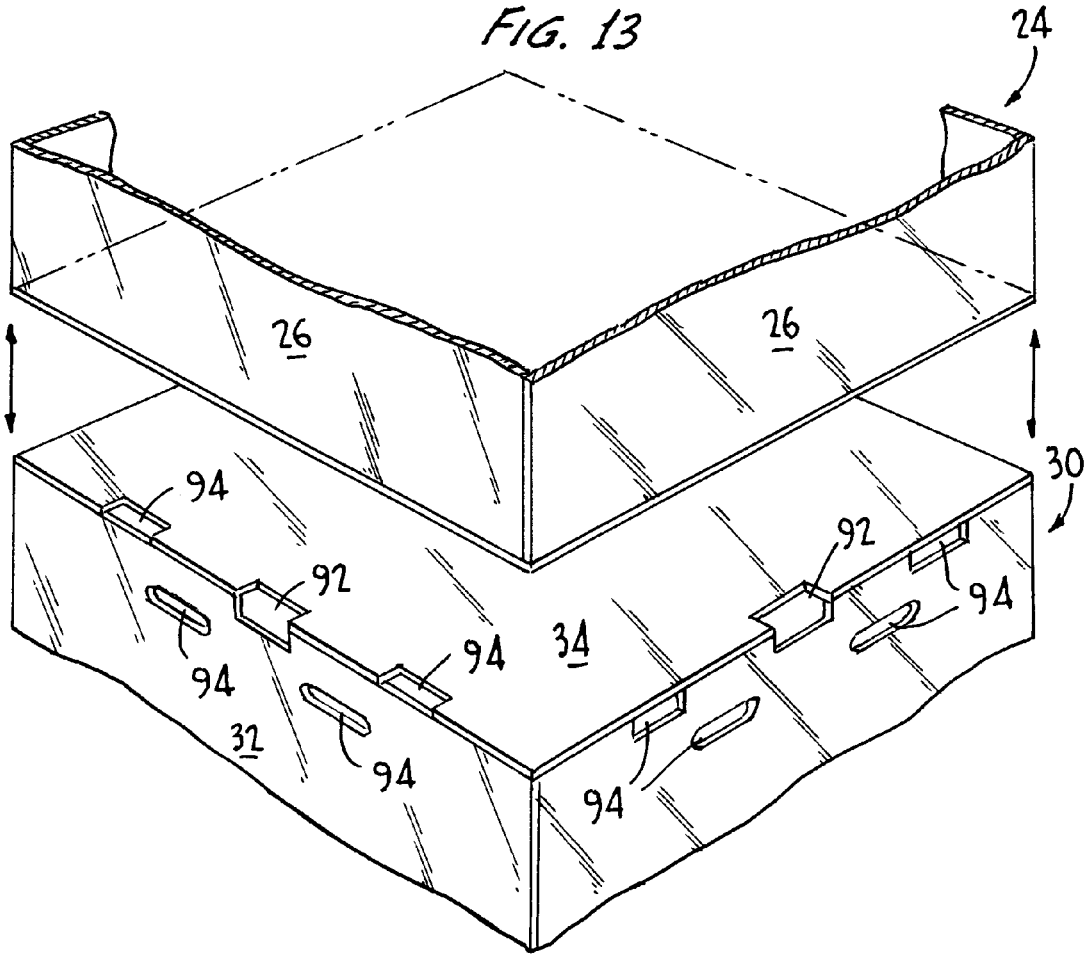
FIG. 13 illustrates different styles of openings for the housing members of the apparatus of the invention.

One example of a positioning member 50 which is rotatable is shown in FIGS. 4 and 5. In this embodiment, the positioning member 50 includes a base 52 and a rotatable member 54 having a first component 56 and a second component 58. The first component 56 of the rotatable member 54 is secured to the base 52 and the second component 58 of the rotatable member 54 is secured to the top wall 34 of the first housing member 30 or to a separate component which is then secured to the top wall 34 of the first housing member 30.

The positioning member 50 may be held in place between the first housing member 30 and the water cooler bottle 90 in any suitable manner including, but not limited to, gravity, adhesive, Velcro® or Velcro®-type fasteners, or the like. The positioning member 50 may also include any suitable weight balancing mechanism as necessary to maintain the water cooler display apparatus 20 balanced on top of and around the water cooler bottle 90.

The water cooler display apparatus 20 may also include a second housing member 24, such as shown for example in FIGS. 2, 3 and 8-12. The second housing member 24 may be operatively positioned on top of the first housing member 30. The second housing member 24 of the water cooler display apparatus 20 includes side walls 26 which may be of the same or different size, width and/or shape as the side walls 32 of the first housing member 30. The side walls 26 of the second housing member 24 may be constructed and arranged in the same or similar manner as the side walls 32 of the first housing member 30 as set forth above. Alternatively, the side walls 26 of the second housing member 24 may be constructed and arranged in any suitable manner different from the first housing member while providing the desired functions.

In a preferred embodiment, the second housing member 24 preferably has a bottom wall 28 and an upper end 48 with an opening therein. The bottom wall 28 may be connected to the lower part 46 of the side walls 26 of the second housing member 24. The bottom wall 28 may be continual or unitary with the side walls 26 of the second housing member 24 and be connected directly thereto or the bottom wall 28 may be separate from the side walls 26 of the second housing member 24 and be connected thereto by any suitable connecting members 40. In a preferred embodiment, the bottom wall 28 is preferably perpendicular to or substantially perpendicular to the side walls 26 of the second housing member 24.

The connecting members 40 on the first housing member 30 and the second housing member 24 may be any suitable connecting members. In a preferred embodiment, the connecting members 40 are substantially L-shaped members. A channel or groove 72 is operatively positioned in each free end 70 of the connecting member 40, such as shown for example in FIGS. 4-7. The channels 72 are constructed and arranged to be of a size so that the edges of the respective side walls 26,32, top wall 34 and/or bottom wall 28 may be secured therein. The walls may be held in the grooves or channels 72 of the connecting members 40 by friction-fit or any other suitable manner, e.g., set-screw 71.

The second housing member 24 and the first housing member 30 may be attached together by any suitable means or the second housing member 24 may be placed on the top wall 34 of the first housing member 30 of the water cooler display apparatus 20. The second housing member 24 may have at least one suitable projection member 74 which contacts the top wall 34 of the first housing member 30, such as shown for example in FIGS. 4 and 5. In another embodiment however, the second housing member 24 and the first housing member 30 may be in direct contact with each other without any projection member 74 therebetween.

In a preferred embodiment, the second housing member 24 is preferably of a height less than the height of the first housing member 30 of the water cooler display apparatus 20. However, the second housing member 24 and the first housing member 30 may each be of any suitable height.

The second housing member 24 may hold various items as desired by a user to be stored therein such as, but not limited to, food items, paper, office supplies, paper products, toys, and/or the like, such as shown in FIGS. 9-12.

The second housing member 24 of the water cooler display apparatus 20 is preferably operatively positioned on top of the first housing member 30. The second housing member 24 may be rotatable in conjunction with the first housing member 30 of the water cooler display apparatus 20 (such as described above where the second housing member is connected to the first housing member by projection 74), rotatable independent from the first housing member 30 (e.g., a second rotation element, such as a Lazy Susan, is positioned between the bottom wall of the second housing member and the top wall of the first housing member) or the first housing member 30 is stationary and the second housing member 24 is rotatable independent of the first housing member 30, such as shown for example in FIGS. 6 and 7. In this embodiment, the top wall 34 of the first housing member 30 has a central opening 80 and a downwardly projecting arm 82 extending from the circumference of the central opening 80. The downwardly projecting arm 82 rests on the top of the water cooler bottle 90. At least one turning member 84 is operatively positioned on the bottom of the bottom wall 28 of the second housing member 24. The at least one turning member 84 contacts the downwardly projecting arm 82 and rotates thereon thereby rotating the second housing member 24.

The at least one means for securing secures predetermined items to one or more exterior surfaces of the housing members. The means for securing may be a plurality of securing members 60 which are operatively positioned on the side walls of the first and/or second housing members, preferably on, at or near the upper part 44 of the first housing member 30 and/or on, at or near the upper end 48 of the second housing member 24 of the water cooler display apparatus 20. More particularly, the plurality of securing members 60 may be constructed and arranged to be positioned over, around or near the upper part 44 or upper edge of the side walls 32 of the first housing member 30 and/or positioned over, around or near the upper end 48 of the second housing member 24 of the water cooler display apparatus 20. If the first housing member is constructed in an integral fashion without the need of connecting members 40, the top and/or side walls can be integral so as to leave an opening in a top portion, e.g., where the top and side walls meet 92 or in the top or side wall per se 94, such as shown schematically in FIG. 13.

The securing members 60 may be any suitable securing member such as hooks, clips, fasteners, magnets, Velcro®/adhesive pads, suction elements, and/or the like. The plurality of securing members 60 are constructed and arranged to hold or secure any suitable number of items on the water cooler display apparatus 20 such as, but not limited to, dish towels, pot holders, oven mitts, cooking utensils, pictures or picture holders, paper, bulletin board, calendar, file holder, storage container and/or the like, such as shown for example in FIGS. 9-12.

The water cooler display apparatus 20 may be constructed of any suitable material(s) including, but not limited to, plastic, metal, glass, a combination thereof and/or the like.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. An apparatus for positioning, storing or displaying items on a water cooler, the apparatus including a water bottle having a cylindrical shape and a support for said water bottle having a means for dispensing water, comprising:

a first housing member having a plurality of side walls, a top wall and a lower end which is at least in part open and said lower end not comprising a dispenser for said water bottle, the first housing member being adapted to be positioned on and around said water bottle of said water cooler wherein said side walls substantially enclose said water bottle and there is a space between said plurality of sidewalls and said water bottle; and a positioning member operatively positioned on a bottom surface of the top wall of the first housing member and wherein a first end of the positioning member is secured to the bottom surface of the top wall and an opposite end of the positioning member is operatively positioned on the top surface of said water bottle;

wherein the first housing member includes one or more means for securing predetermined items not part of said apparatus to one or more exterior surfaces of the first housing member, including said side walls.

2. The apparatus of claim 1, wherein the means for securing include a plurality of openings in the top wall, side walls, or a combination thereof of the first housing member and one or more securing members operatively positioned in said openings, wherein the one or more securing members are constructed and arranged to hold or secure predetermined items on the first housing member.

3. The apparatus of claim 1, wherein the means for securing include adhesive backed securing members.

4. The apparatus of claim 1, further comprising:

a second housing member having a plurality of side walls, a bottom wall and an upper end which is at least in part open, wherein the second housing member is operatively positioned on the first housing member.

5. The apparatus of claim 1, wherein one of the plurality of side walls of the first housing member is a door.

6. The apparatus of claim 1, wherein the positioning member renders the first housing member rotatable.

7. An apparatus for positioning, storing or displaying items on a water cooler, the apparatus including a water bottle having a cylindrical shape and a support for said water bottle having a means for dispensing water, comprising:

a first housing member having a plurality of side walls, a top wall and a lower end which is at least in part open and said lower end not comprising a dispenser for said water bottle, the first housing member being adapted to be positioned over and around said water bottle of said water cooler wherein said side walls substantially enclose said water bottle and there is a space between said plurality of sidewalls and said water bottle;

a second housing member having a plurality of side walls, a bottom wall and an upper end which is at least in part open, the second housing member operatively positioned on top of the first housing member;

a positioning member operatively positioned on a bottom surface of the top wall of the first housing member and wherein a first end of the positioning member is secured to the bottom surface of the top wall and an opposite end of the positioning member is operatively positioned on the top surface of said water bottle; and one or more securing members operatively positioned on the first housing member, or the second housing member, or a combination thereof, wherein the one or more securing members are constructed and arranged to hold or secure predetermined items not part of said apparatus on the first housing member, the second housing member, or a combination thereof, including the side walls of said first and/or second housing members.

8. The apparatus of claim 7, wherein the top wall is perpendicular or substantially perpendicular to the plurality of side walls of the first housing member.

9. The apparatus of claim 7, wherein the bottom wall is perpendicular or substantially perpendicular to the plurality of side walls of the second housing member.

10. The apparatus of claim 7, wherein the top wall is connected to at least one of the plurality of side walls of the first housing member by at least one connecting member.

11. The apparatus of claim 7, wherein the bottom wall is connected to at least one of the plurality of side walls of the second housing member by at least one connecting member.

12. The apparatus of claim 7, wherein one of the plurality of side walls of the first housing member is a door.

13. The apparatus of claim 7, wherein the side walls of the second housing member are of a height less than a height of the side walls of the first housing member.

14. The apparatus of claim 10, wherein the at least one connecting member is substantially L-shape having a first free end and a second free end and having a first channel operatively positioned in the first free end and a second channel operatively positioned in the second free end.

15. The apparatus of claim 14, wherein an edge of one of said plurality of side walls of the first housing member is operatively positioned in the first channel of the at least one connecting member and an edge of the top wall of the first housing member is operatively positioned in the second channel of the at least one connecting member.

16. The apparatus of claim 11, wherein the at least one connecting member is substantially L-shape having a first free end and a second free end and having a first channel operatively positioned in the first free end and a second channel operatively positioned in the second free end.

17. The apparatus of claim 16, wherein an edge of one of said plurality of side walls of the second housing member is operatively positioned in the first channel of the at least one connecting member and an edge of the bottom wall of the second housing member is operatively positioned in the second channel of the at least one connecting member.

18. The apparatus of claim 7, wherein the positioning member renders at least the first housing member rotatable.

19. The apparatus of claim 7, wherein the second housing member is operatively positioned on top of the first housing member.

20. The apparatus of claim 7, wherein the one or more securing members are operatively positioned on, at or over an upper part of the plurality of side walls of the first housing member or on, at or over an upper end of the plurality of side walls of the second housing member or a combination thereof.

21. The apparatus of claim 7, wherein the one or more securing members includes at least one of hooks, clips, fasteners, and magnets.

22. The apparatus of claim 7, wherein the plurality of side walls of the first housing member are one of rectangular, square, circular, oval, and diamond shape.

23. The apparatus of claim 7, wherein the plurality of side walls of the second housing member are one of rectangular, square, circular, oval, and diamond shape.

24. The apparatus of the claim 7, wherein the apparatus is constructed of a material of metal, glass, plastic or a combination thereof.

* * * * *